US005484068A

United States Patent [19]

Huang

[11] Patent Number: 5,484,068

[45] Date of Patent: Jan. 16, 1996

[54] FRAMEWORK MOUNTING STRUCTURE

[76] Inventor: Che-Hsiung Huang, No. 106, Ta Tun Road, Taipei, Taiwan

[21] Appl. No.: 192,748

[22] Filed: Feb. 7, 1994

[30] Foreign Application Priority Data

Feb. 8, 1993 [DE] Germany ..... 9301716.2 U

[51] Int. Cl.[6] ..... A47F 5/00

[52] U.S. Cl. ..... 211/193; 248/245; 248/297.31

[58] Field of Search ..... 211/193, 207, 211/187, 90; 248/244, 245, 246, 247, 242, 243, 297.2, 225.1, 218.4, 219.1

[56] References Cited

U.S. PATENT DOCUMENTS

| | | | |
|---|---|---|---|
| 3,462,110 | 8/1969 | Cheslock | 248/245 X |
| 3,463,433 | 8/1969 | Stein et al. | 248/242 |
| 3,561,713 | 2/1971 | Berkowitz | 248/242 |
| 4,065,904 | 1/1978 | Taylor et al. | 211/193 X |
| 4,163,537 | 8/1979 | Mourgue | 248/297.2 X |
| 4,533,104 | 8/1985 | Bell | 248/245 |
| 4,621,938 | 11/1986 | Weilow | 211/207 X |
| 4,674,723 | 6/1987 | Bayuk | 248/247 X |
| 5,086,930 | 2/1992 | Saeks | 211/22 |

*Primary Examiner*—Robert W. Gibson, Jr.
*Attorney, Agent, or Firm*—Browdy and Neimark

[57] ABSTRACT

A framework mounting structure is disclosed including a post made from an aluminum profile having at least one longitudinal groove through its length; a connecting frame having a hook member hooked in either of the at least one longitudinal groove, a stop member stopped against the post on the outside, and a presser member stopped against the inside surface of the longitudinal groove on which the hook member hooks; and a supporting frame adjustably connected to the connecting frame by pins for supporting a carrying board.

2 Claims, 11 Drawing Sheets

C

B

A

FRAMEWORK MOUNTING STRUCTURE

BACKGROUND OF THE INVENTION

The present invention relates to a framework mounting structure which comprises a connecting frame connected to an aluminum post through hooked joints to hold a supporting frame by pins.

A show window or show rack, or the partition of an office may be built up by connecting different frames together for the advantage of high flexibility and mobility. FIG. 1 illustrates a framework mounting structure according to the prior art, which uses a connecting frame 1*a* fastened to a frame bar 2*a* to hold a rod. The connecting frame 1*a* comprises notches prongs 12*a* at one end 11*a* respectively hooked on grooves 21*a* on the frame bar 1*a*, and then fastened tightly by a screw 13*a*. This mounting procedure is complicated. When the connecting frame 1*a* has been fixed to the frame bar a, its position can no longer be changed relative to the frame bar 2*a*.

SUMMARY OF THE INVENTION

The present invention eliminates the aforesaid disadvantages. It is therefore an object of the present invention to provide a framework mounting structure which is easy to assemble. It is another object of the present invention to provide a framework mounting structure which can be conveniently adjusted to change the angular position of the supporting frame thereof.

According to one aspect of the present invention, the framework mounting structure comprises a post made from an aluminum profile having at least one longitudinal groove through its length; a connecting frame having a hook member hooked in either of the at least one longitudinal groove, a stop member stopped against the post on the outside, and a presser member stopped against the inside surface of the longitudinal groove on which the hook member hooks; and a supporting frame adjustably connected to the connecting frame by pins for supporting a carrying board. According to another aspect of the present invention, the supporting frame has an elongated slot and a series of pin holes respectively made on a mounting plate thereof for connecting to the connecting frame; the connecting frame has an upper pin hole connected to the elongated slot on the mounting plate of the supporting frame by a pin and a clamp, and a lower pin hole connected to either pin hole on the mounting plate of the supporting frame by a pin. By connecting the lower pin hole on the connecting frame to another pin hole on the mounting plate of the supporting frame, the angular position of the supporting frame relative to the connecting frame is changed.

DETAILED DESCRIPTION OF THE PREFERRED EMBODIMENT

Figure 1:
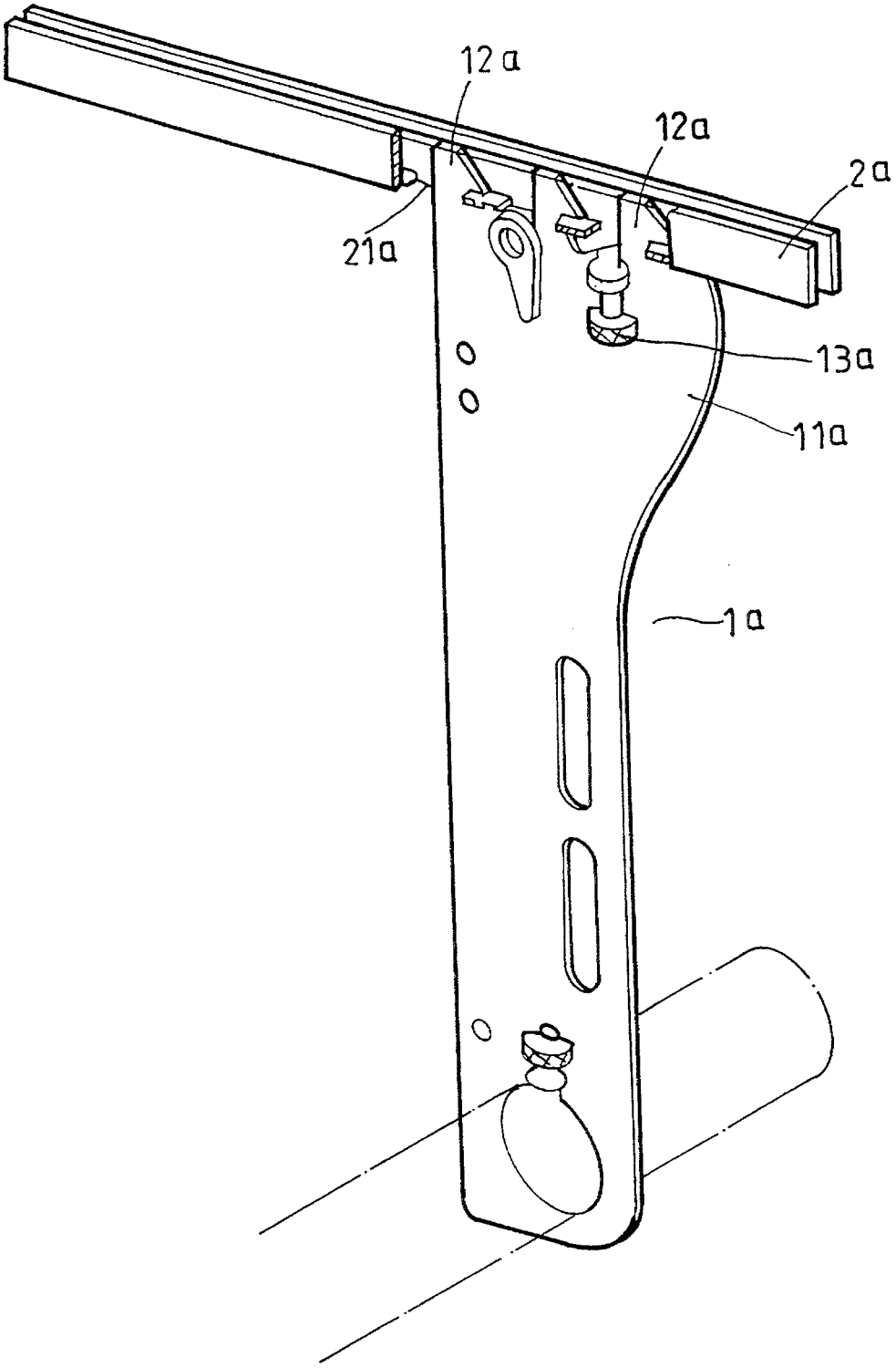
FIG. 1 (PRIOR ART)
FIG. 1 is a perspective view showing a connecting frame connected to a frame bar according to the prior art.
Figure 2:
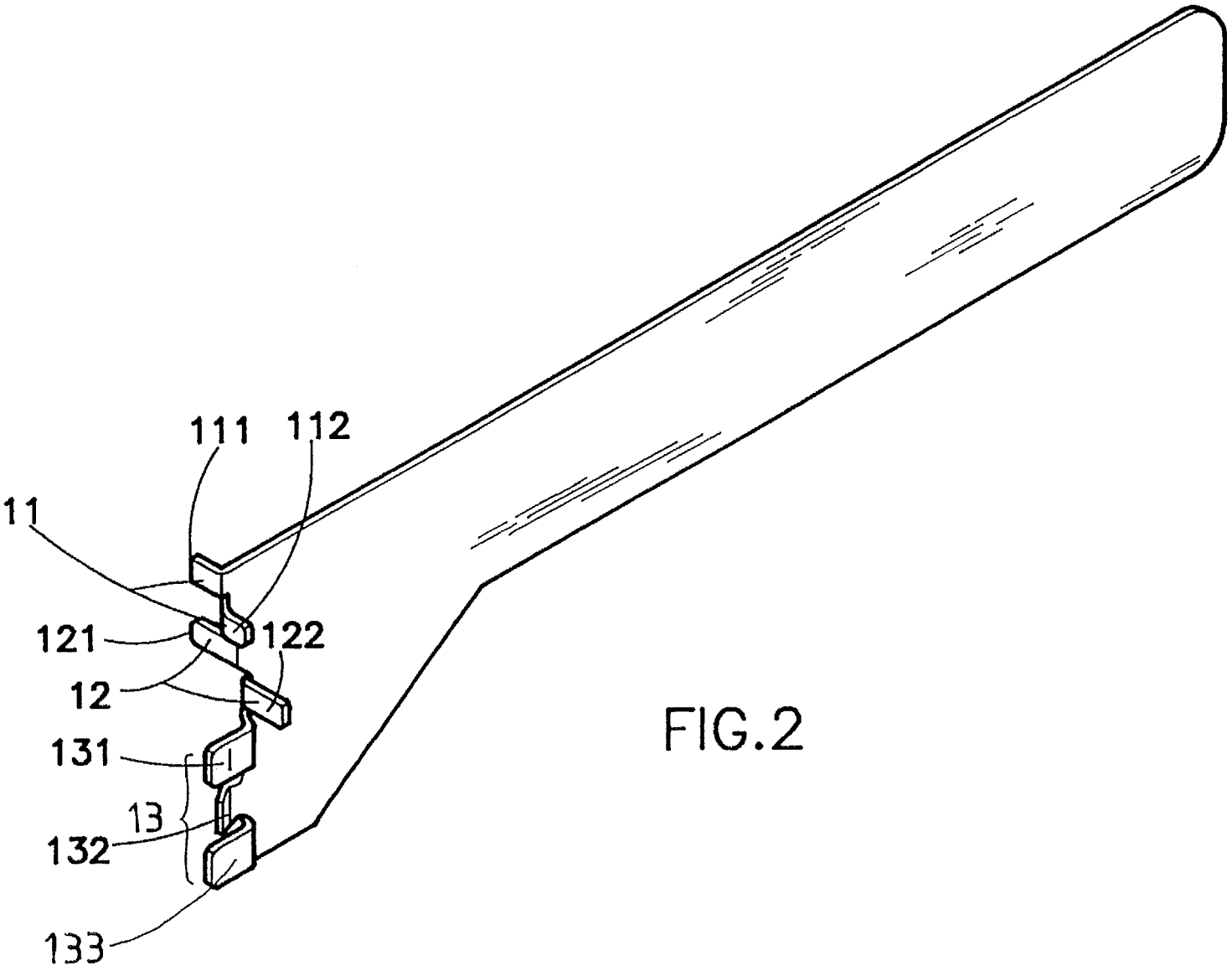
FIG. 2 is an elevational view of a connecting frame according to the present invention.
Figure 3:
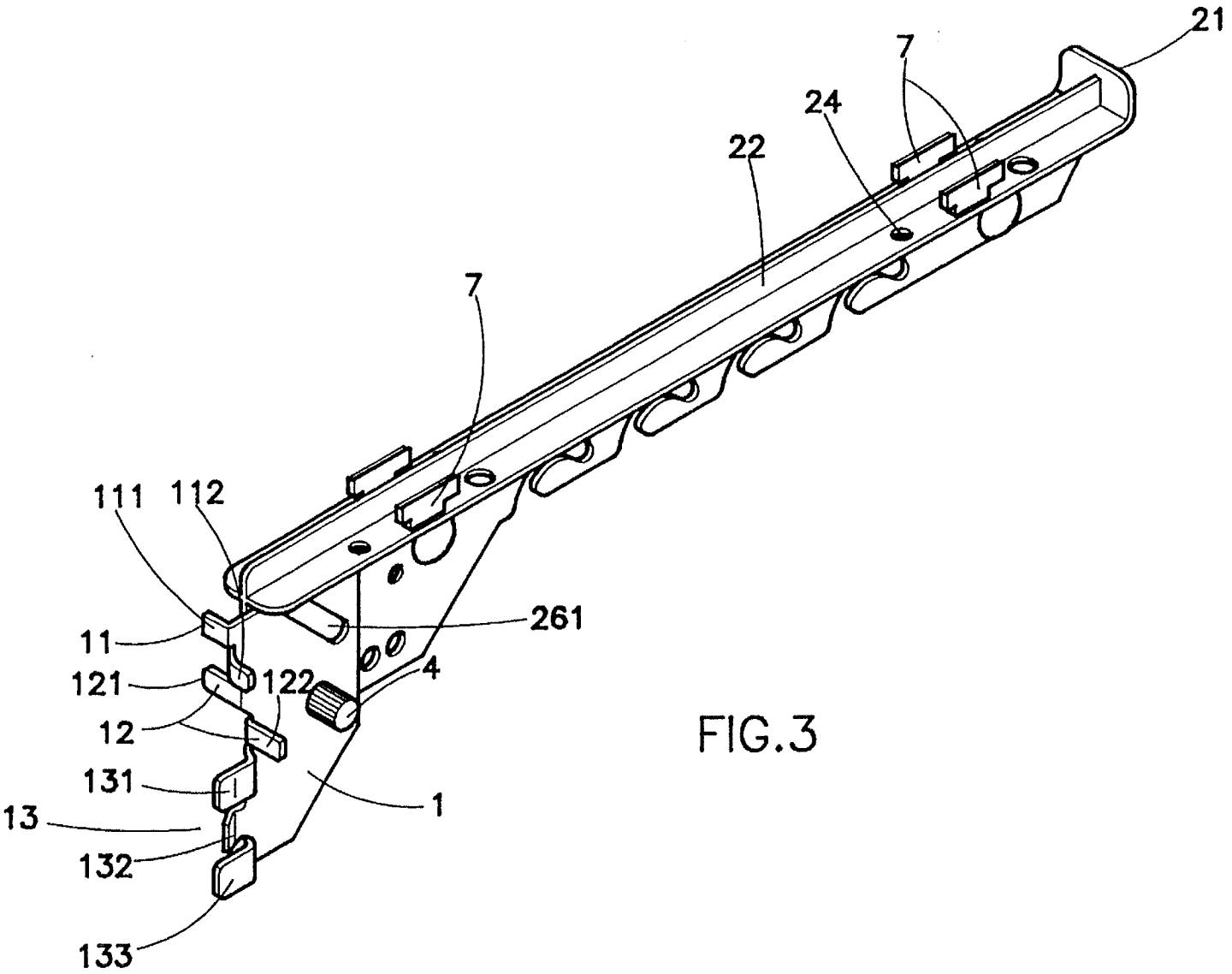
FIG. 3 is an elevational view showing the connecting frame connected to a supporting frame according to the present invention.
Figure 4:
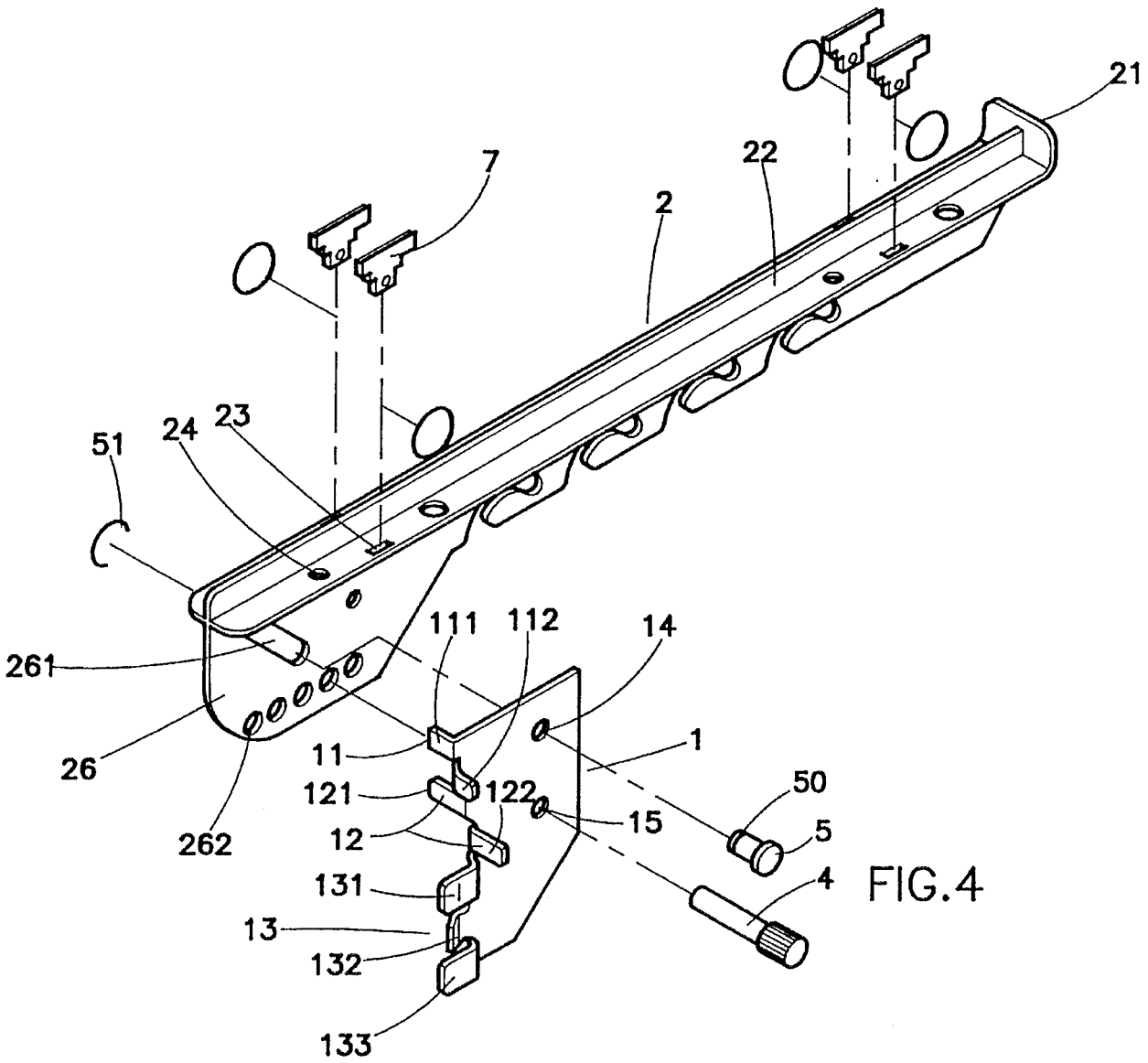
FIG. 4 is a dismantled view of FIG. 3.
Figure 5:
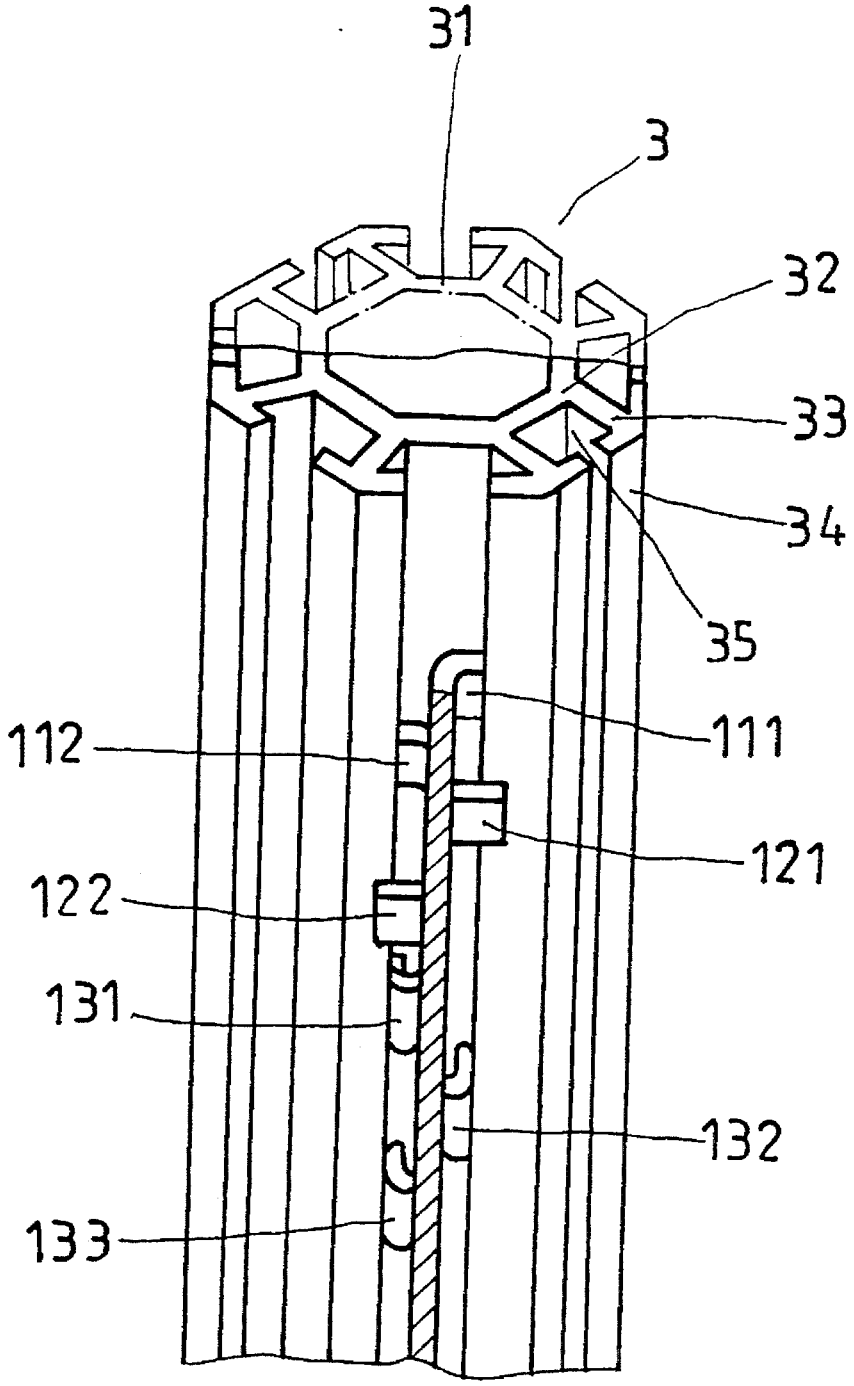
FIG. 5 is a partial sectional view of the connecting frame fastened to a post according to the present invention.
Figure 6:
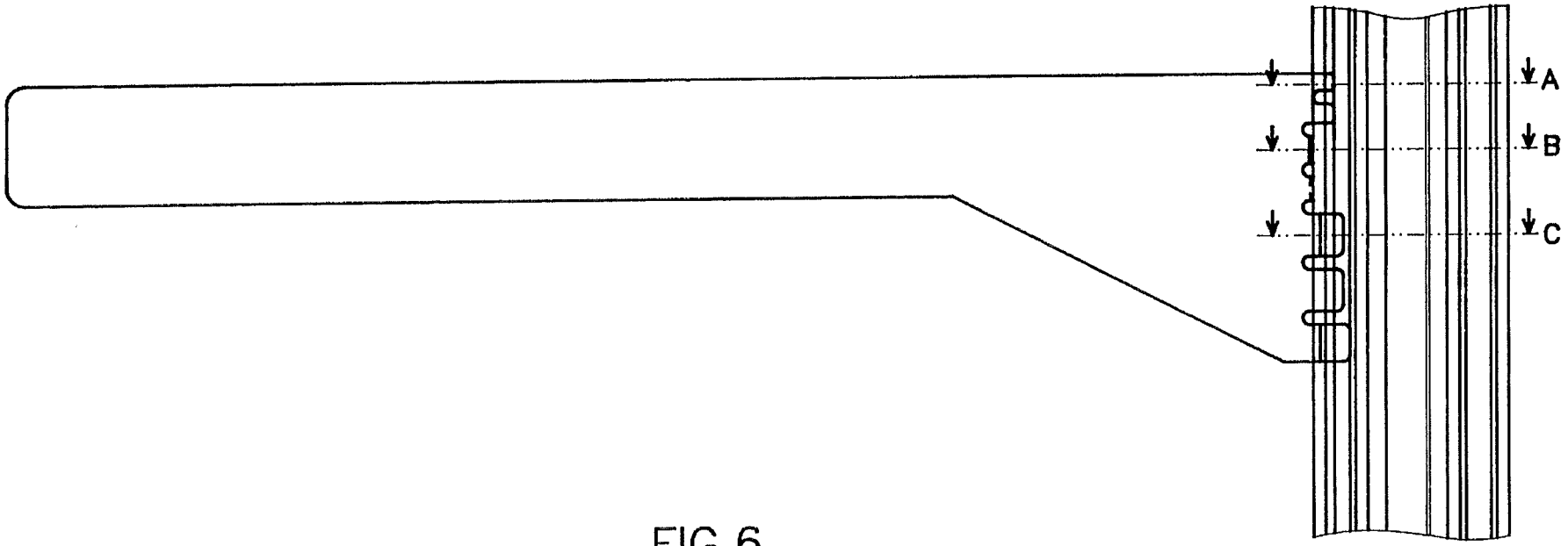
FIG. 6 is a perspective view showing the connecting frame fastened to the post.
Figure 9:
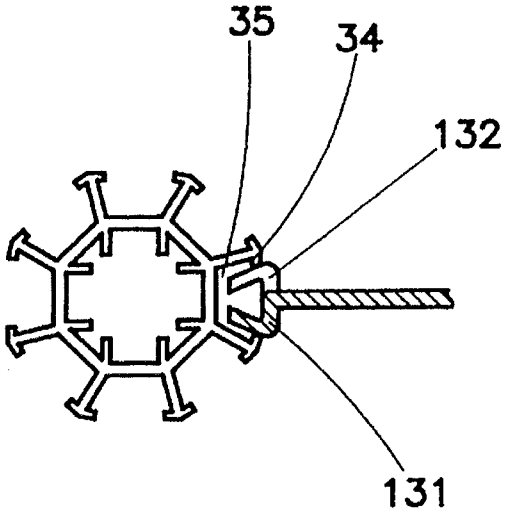
FIG. 9 is a cross section along line C in FIG. 6.
Figure 8:
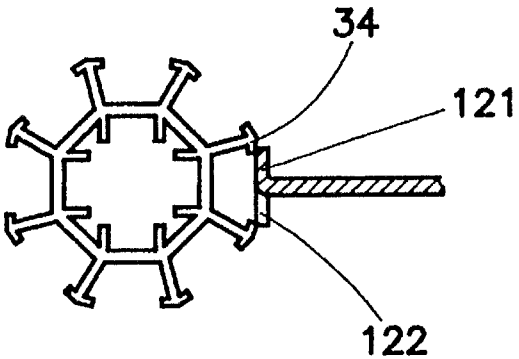
FIG. 8 is a cross section along line B in FIG. 6.
Figure 7:
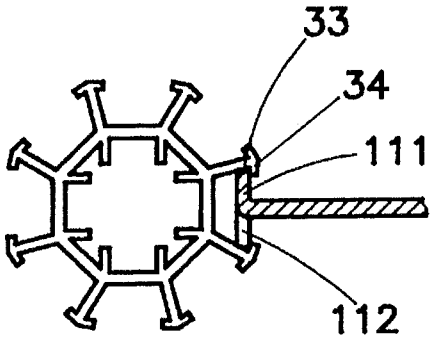
FIG. 7 is a cross section along line A in FIG. 6.

Referring to FIGS. 2,3,4 and 5, a framework mounting structure in accordance with the present invention is generally comprised of connecting frame 1, supporting frame 2, and post 3.

Connecting frame 1 is made from a thin, elongated flat plate, comprising two reversed hooks 111,112 on one end vertically spaced at the top (in the direction shown in FIG. 2), three presser strips 131,132,133 vertically spaced on the same end at the bottom and alternatively projected in reversed directions, and two reversed stop strips 121,122 vertically spaced between the reversed hooks 111,112, and the presser strips 131,132,133, and two pin holes, namely, the upper pin hole 14 and the lower pin hole 15 spaced at suitable locations.

Supporting frame 2 fits over the connecting frame 1, comprising a fender 21 on one end at the top, a longitudinal division plate 22 extended from the fender 21 in the middle toward the opposite end, mounting slots 23 and pin holes 24 symmetrically disposed on two opposite ends at two opposite sides, a row of hooks 25 longitudinally spaced in the middle at the bottom, and a mounting plate 26 on the opposite end (relative to the fender 21) at the bottom. The mounting plate 26 comprises an elongated slot 261 and a row of pin holes 262 for connecting the pin holes 14,15 on the connecting frame 1.

Post 3 is made from a hollow, polygonal aluminum profile 31 having a plurality of longitudinal ribs 33 radially extended outwards from the angles 32, each of which being terminated to a longitudinal arrowhead 34, and a plurality of longitudinal grooves 35 respectively defined between either two adjacent ribs 32.

Referring to FIG. 3 and 4 again, a first headed pin 4 is inserted through the lower pin hole 15 on the connecting frame 1 into either pin hole 262 on the mounting plate 26 of the supporting frame 2, a second headed pin 5 is then inserted through the upper pin hole 14 on the connecting frame 1 into the elongated slot 261 on the mounting plate 26 of the supporting frame 2 and secured in place by clamping a clamp 51 on an annular groove 50 on the plain tail of the second headed pin 5. Therefore, the connecting frame 1 is fastened to the supporting frame 2.

Referring to FIGS. 5 through 9, the connecting frame 1 comprises a unitary hook member 11 (namely, the hooks 111,112), a unitary stop member 12 (namely, the stop strips 121,122), and a unitary presser member 13 (namely, the presser strips 131,132,133) vertically spaced at one end. The height (in longitudinal direction) of the hook member 11 is higher than that of the stop member 12 and the presser member 13, but shorter than the depth of the longitudinal grooves 35 on the post 3. Therefore, the connecting frame 1 can be conveniently fastened to the post 3 by hooking the hooks 111,112 in either longitudinal groove 35 for permitting the stop strips 121,122 to be stopped against the arrowhead 34 of respective ribs 33 on the outside. When hooked, the presser strips 131,132,133 are respectively stopped against the inside surface of the longitudinal groove 35. When connected, the stop member 12 of the connecting frame 1 is stopped against the respective arrowheads 34 on the outside and served as the fulcrum in a lever, the hook member 11 is hooked in the longitudinal groove 35 and served as the load, and the presser member 13 is stopped against the inside surface of the longitudinal groove 35 and served as the effort.

Figure 10:
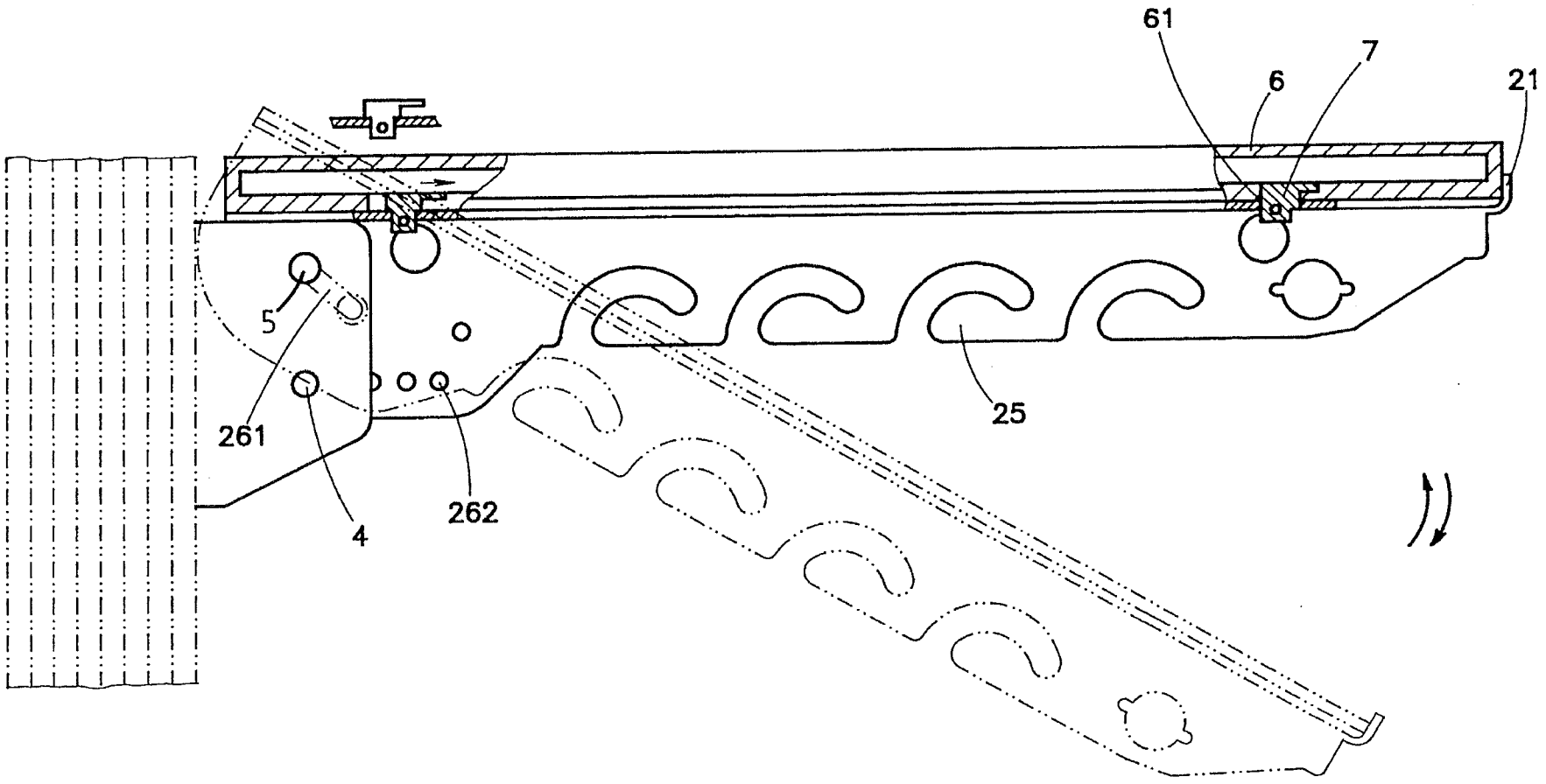
FIG. 10 is a plain view showing the supporting frame adjusted to another angular position on the connecting frame.

Referring to FIG. 10, the angular position of the connecting frame 1 relative to the supporting frame 2 can be adjusted within 90° angle by changing the position of the first headed pin 4 on the row of pin holes 262.

Figure 11:
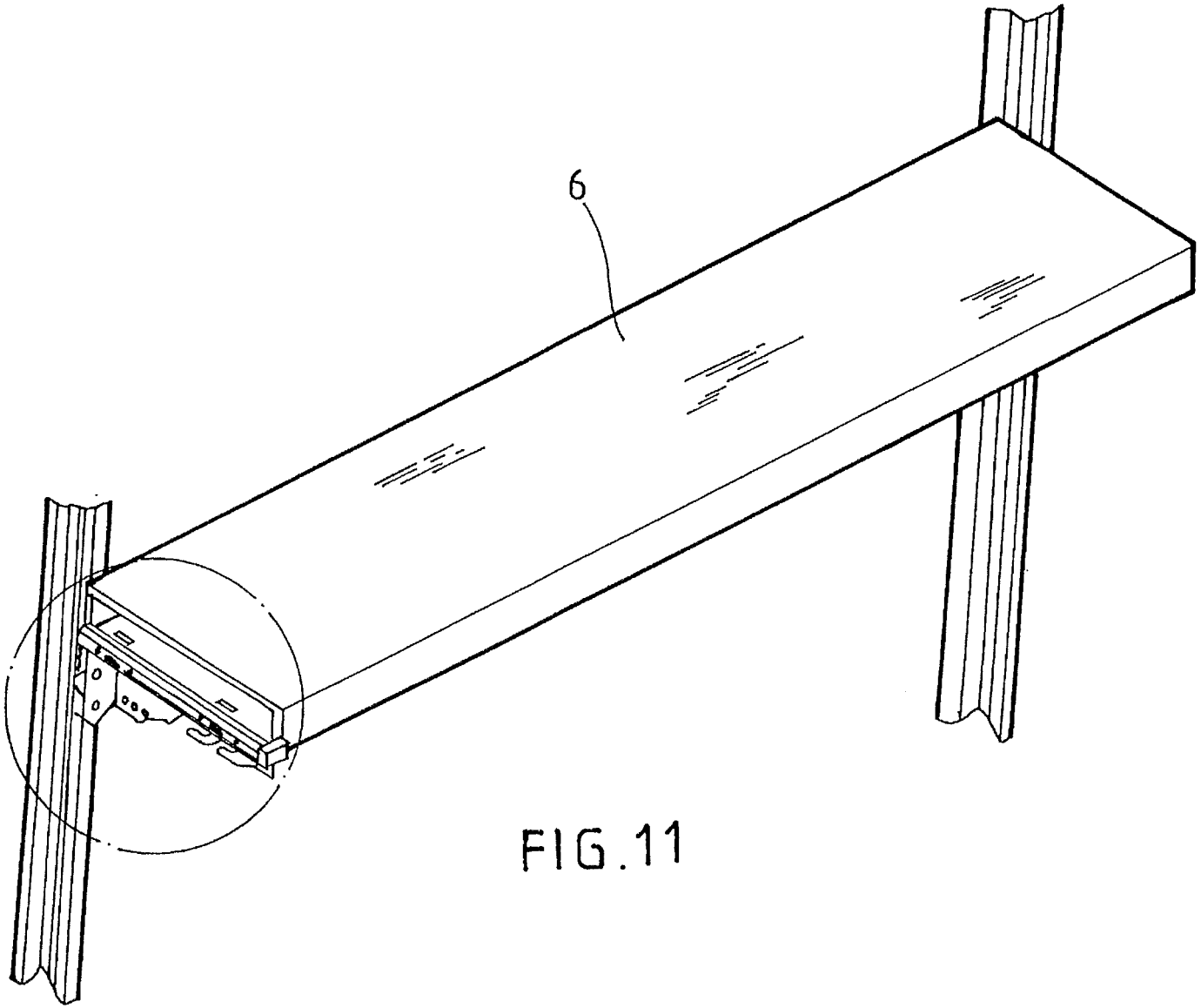
FIG. 11 illustrates a carrying board fastened to the supporting frame by locking plates.
Figure 11A:
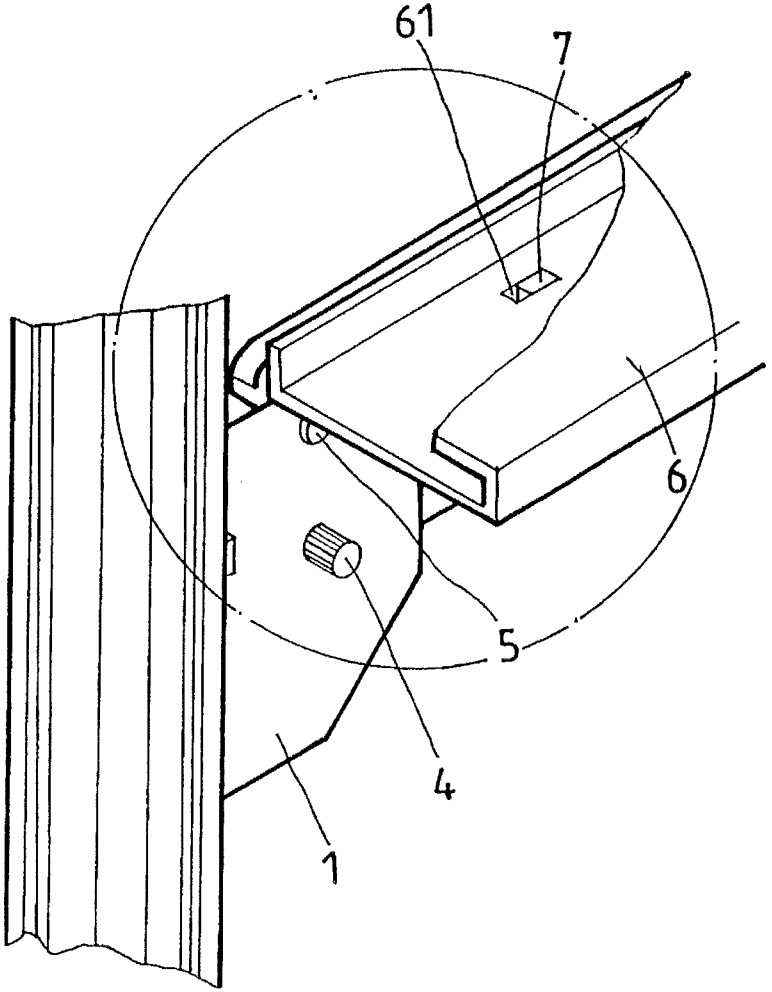
FIG. 11A is an enlarged view of the circled portion of FIG. 11.

Referring to FIG. 11A, by inserting locking plates 7 through holes 61 on a board 6 into respective mounting holes 23 on the supporting frame 2, the board 6 is fastened to the supporting frame 2 for carrying things.

Figure 12:
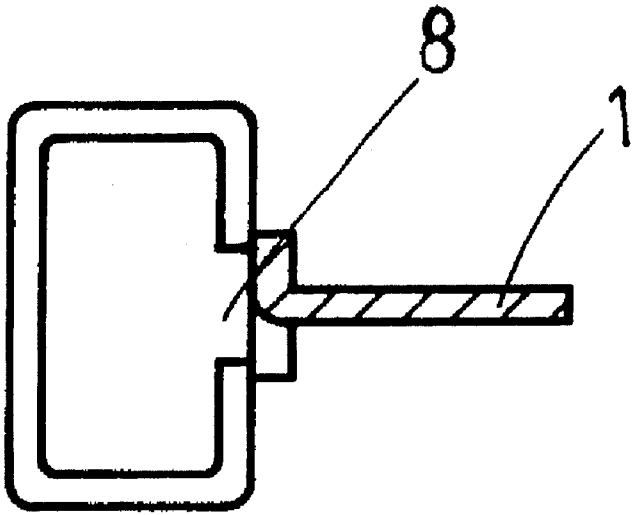
FIG. 12 is a cross section showing the connecting frame hooked in the T-shaped groove on a post according to the alternate form of the present invention.

Referring to FIG. 12, therein illustrated is an alternate form of the post. According to this alternate form, the post is made from an aluminum profile having a T-shaped groove 8 through its length for fastening the connecting frame 1.

What is claimed is:

1. A framework mounting structure comprising:

a post made from an aluminum profile having at least one longitudinal groove on the outside through its length;

a connecting frame having a top end, a bottom end, an inner edge and an outer edge, and made from a thin, elongated flat plate detachably fastened to said post, said connecting frame comprising two reversed hooks vertically spaced along the inner edge at the top and respectively hooked in said longitudinal groove, three presser strips vertically spaced on along the inner edge at the bottom and alternatively projected in reversed directions and respectively stopped against the inside surface of the longitudinal groove on which said hooks hook, and two reversed stop strips vertically spaced between said reversed hooks and said presser strips and respectively stopped against said post on the outside, and an upper pin hole adjacent the outer edge of the connecting frame and lower pin hole adjacent the outer edge of the connecting frame; and a supporting frame connected to said connecting frame, said supporting frame comprising a fender on one end distal the connecting frame at the top, a longitudinal division plate extending from said fender in the middle toward an opposite end, mounting slots and holes symmetrically disposed adjacent the one end and the opposite end at two opposite sides of the longitudinal division plate for fastening a board, a row of hooks longitudinally spaced intermediate the one end and the opposite end at the bottom of the longitudinal division plate, and a mounting plate on an opposite end at the bottom, said mounting plate comprising an elongated slot connected to said upper pin hole on said connecting frame by a first pin and a clamp, and a row of supporting frame pin holes alternatively connected to said lower pin hole on said connecting frame by a second pin.

2. The framework mounting structure of claim 1 wherein said post is made from a hollow, polygonal aluminum profile having a plurality of longitudinal ribs radially extended outwards at angles, each longitudinal rib being respectively terminated to a longitudinal arrowhead, and a plurality of longitudinal grooves respectively defined between either two adjacent ribs.

* * * * *